US009611703B2

(12) United States Patent
Spriggs

(10) Patent No.: US 9,611,703 B2
(45) Date of Patent: Apr. 4, 2017

(54) DRILL PIPE IDENTIFICATION METHOD AND APPARATUS

(71) Applicant: Rodger W. Spriggs, Fullerton, CA (US)

(72) Inventor: Rodger W. Spriggs, Fullerton, CA (US)

( * ) Notice: Subject to any disclaimer, the term of this patent is extended or adjusted under 35 U.S.C. 154(b) by 366 days.

(21) Appl. No.: 14/163,969

(22) Filed: Jan. 24, 2014

(65) Prior Publication Data

US 2014/0326507 A1 Nov. 6, 2014

Related U.S. Application Data

(60) Provisional application No. 61/756,888, filed on Jan. 25, 2013.

(51) Int. Cl.
*E21B 12/00* (2006.01)
*E21B 17/00* (2006.01)

(52) U.S. Cl.
CPC ..... *E21B 17/006* (2013.01)

(58) Field of Classification Search
CPC ..... E21B 19/00; E21B 17/006
See application file for complete search history.

(56) References Cited

U.S. PATENT DOCUMENTS 5,608,199 A * 3/1997 Clouse, III ..... G06K 19/041 235/435
2011/0315261 A1* 12/2011 Coleman ..... E21B 17/006 138/104

* cited by examiner

*Primary Examiner* — Brad Harcourt
(74) *Attorney, Agent, or Firm* — Roy A. Ekstrand

(57) ABSTRACT

A drill pipe identification method and apparatus utilizes a unique drill pipe identification code which is applied to each drill pipe by the manufacturer or in the field. The encoded pipe identification data is applied to the drill pipe utilizing a selected one of a variety of processes. These processes include welding, burning, optical etching utilizing lasers or welding to deposit a raised bead which is detected by tactical surface variation. The encoded identifier supported upon each drill pipe as is passes throughout the industry allows the user to investigate the history of the drill pipe which is accumulated in a central storage facility. As each user applies processes to the pipe, such as inspection or restoration, and/or employs the drill pipe in a drilling operation, the data of use is communicated to the central storage facility to enhance the drill pipe history available to subsequent potential users having come into possession of the drill pipe.

10 Claims, 4 Drawing Sheets

DRILL PIPE IDENTIFICATION METHOD AND APPARATUS

CROSS-REFERENCE TO RELATED APPLICATIONS

This Application claims the benefit of and priority under 35 U.S.C 119(e) of U.S. Provisional Patent Application No. 61/756,888, entitled DRILL PIPE IDENTIFICATION METHOD AND APPARATUS, filed Jan. 25, 2013 in the name of Rodger W. Spriggs, the disclosure of which is incorporated herein by reference.

FIELD OF THE INVENTION

This invention relates generally to methods and apparatus for use in oil well drilling operations and particularly to methods and apparatus for assisting oil well operators in avoiding drill pipe failures.

BACKGROUND OF THE INVENTION

Modern oil well drilling technology has become extremely sophisticated, complex and high cost. Modern oil well drillers can reach depths which in the recent past would be unimaginable. In addition, complex drilling apparatus enables oil well drillers to drill at angles or exercise turns deep in the earth to drill in a given direction either horizontally, obliquely or vertically. Despite the extreme complexity of modern drilling apparatus, the basics of the procedure has remained relatively straight forward.

In an oil well drilling operation, a drill head is powered downwardly from the well site into the earth and is supported by a plurality of drill pipe segments typically referred to as "drill pipes". The drill pipe segments include male and female ends which facilitate serially coupling the drill pipe segments to form extended strings of drill pipe. A drill rig on the surface at the well site controls and powers the drilling operation and as the drill head advances, successive segments of drill pipe which are often called "sticks" are added to the drill pipe string.

With ever deeper drilling and the capability of vertical, angled and/or horizontal drilling paths, the extent of distance covered in any drilling operation becomes substantial. As the drill head advances, the number of drill pipes joined to drive and support the drill head in a typical operation reaches hundreds or even thousands of drill pipe segments. In this environment, failure of one drill pipe in the extended serial string of segments results in substantial loss of time and money. In order to replace the failed drill pipe much of the drill pipe string must be withdrawn by the well drilling rig segment by segment to extract and replace the failed pipe. Once the failed pipe has been replaced, the entire string must again be reassembled and lowered into the well hole segment by segment. This process is extremely expensive and time wasting.

Faced with the daunting economic impact of drill pipe failure, practitioners in the well drilling arts endeavor to make every effort to ensure that each drill pipe used is in sound condition and has not suffered fatigue, corrosion or physical damage such as minute cracking or overstraining in prior use. Toward this end, practitioners employ trained and certified inspectors (often called "level three" inspectors) to examine each drill pipe for level one compliance before the drill pipe is used.

The basic problem in the oil well arts is that the number of drill pipes in existence is enormous and drill pipes are transferred throughout the system among successive user's. In addition, a substantial number of pipe manufacturers provide drill pipes. Accordingly, a typical well operator will have large numbers of drill pipe on the premises which have been received from multiple sources and which have moved throughout the oil drilling industry in some instances being transferred between several operators. As such, the typical well operator is faced with utilizing a substantial number of drill pipes each having a "history" which is difficult if not impossible to determine by examination of the drill pipe. Thus, for each drill pipe, the extent and character of its previous use as well as other critical factors such as the number of reconditioning processes it has received cannot be determined and raises an element of uncertainty and potential risk for the well operator. As a result, despite the use of the above-mentioned level three inspectors, a well operator is unable to assess these other elements in determining whether or not a particular drill pipe is truly suitable for use.

Accordingly, despite substantial efforts and expertise applied to physical examination of drill pipes prior to use, there remains nonetheless a continuing need in the art for a method and apparatus which facilitate the determination of the manufacturer, history of use, history of reconditioning operations and other factors effecting the reliability of a given drill pipe which practitioners in the well drilling arts may utilize in decisions regarding pipe use.

SUMMARY OF THE INVENTION

Accordingly, it is a general object of the present invention to provide an improved drill pipe identification apparatus and method. It is a more particular object of the present invention to provide an improved drill pipe identification apparatus and method which overcomes the limitations and difficulties imposed thereon by the demanding and far-flung world-wide oil drilling environment.

The present invention provides a drill pipe identification method and apparatus by which each drill pipe may be given a unique identification code in a permanent wear-resistant manner. The inventive system applies an encoded series of localized anomalies on the drill pipe to impart permanent markings upon the drill pipe which remain on the drill pipe throughout its use. The markings or coded identification may contain virtually any information deemed important to the well operators. The unique identification of each drill pipe facilitates the tracking of each drill pipe's history of use and reconditioning together with other information such as manufacturing source and the like. In one embodiment of the invention, the coded identification data is applied using welding apparatus while in alternate embodiments electric arc apparatus which burn the coded information upon the pipe may be utilized. By way of further variation, laser engraving apparatus may be used to apply code to the drill pipes. In further accordance with the invention, the system includes pipe code readers which are available to the well operator and are used to decipher the coded identification and other information on the drill pipe. The readers may employ various sensor technologies such as mechanical sensing, optical sensing or magnetic anomaly sensing. In the preferred fabrication of the invention, the identification information and other data is centrally stored and made available to drill pipe users. As each drill pipe moves through the well drilling and operating systems, relevant history information accumulates to comprise a "history" of the drill pipe which is stored and is made available to well operators. As a result, a well operator utilizing the system reader is able to uniquely identify a drill pipe and access pipe history information as to the use, manufacture, reconditioning services etc to which the drill pipe has been subjected.

Thus, in accordance with the present invention, there is provided a method of imparting a drill pipe identification to a drill pipe comprising the steps of: providing a drill pipe encoder having means for imparting localized anomalies to a drill pipe; creating localized anomalies upon a selected area of a drill pipe; and controlling the anomalies in accordance with encoded drill pipe identification data which uniquely distinguishes the encoded drill pipe from all other drill pipes.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention drill pipe identification method and apparatus provides a system by which each drill pipe receives a permanently fixed encoded unique drill pipe identification. Typically, this drill pipe identification comprises an encoded numeric and/or alphabetic drill pipe identification. In the preferred embodiment of the invention, the drill pipe identification is applied to the drill pipe surface using a welding process. Alternatively, however, an electric arc "surface burn" may be utilized. In any event, the marking process applies coded identification data which is permanently affixed to the drill pipe surface and which is differs in a desired characteristic from the host drill pipe surface in its magnetic characteristics physical surface or optical characteristic. As a result, the encoded data is readily detectable by a magnetic anomaly sensing apparatus or alternatively, physical sensing of the engraved or weld data may be utilized. By further alternative, optical sensing of the welded deposited encoded data may be employed. Once the drill pipe has received its permanent identification, successive use and wear will not remove the magnetic or other anomaly created by the marking process. To minimize wear, it is preferred that the marking process be employed proximate to the pin end of the drill pipe. However, alternate locations along the drill pipe may be utilized. At the well site a reader is employed by the well operator to identify the section of pipe and access stored information relevant to the pipe. In the preferred fabrication of the invention, the drill pipe identification data is stored within a central data storage and may be accessed by practitioners within the oil drilling community. In addition, a history for each drill pipe may be stored in combination with the drill pipe identification data to further enhance the system.

Figure 1:
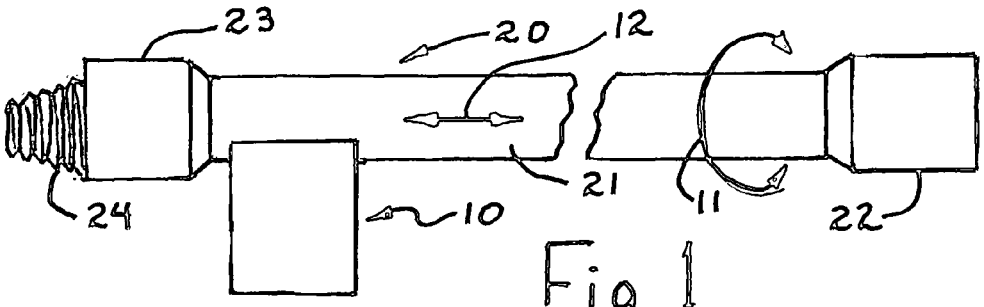
FIG. 1 sets forth a top view of a typical drill pipe having a code application device in conjunction therewith.

More specifically, FIG. 1 sets forth a typical drill pipe generally referenced by numeral 20 together with a pipe marking apparatus constructed in accordance with the present invention and generally referenced by numeral 10. An illustrative embodiment of pipe marking apparatus 10 is set forth below in FIG. 4 in greater detail. However, suffice it to note here that pipe marking device 10 is positioned proximate to drill pipe 20 and is supported by conventional support means (not shown). Drill pipe 20 is of conventional fabrication and thus includes an elongated cylindrical shaft 21 having a box end 22 at one end and a pin end 23 at the opposite end. Box end 22 and pin end 23 are substantially greater in diameter than shaft 21. Pin end 23 supports a tapered thread 24. Conversely, box end 22 supports an internal thread (not shown) which is compatible with thread 24 and which facilitates the attachment of drill pipe 20 (not shown) to form another drill pipe in a string.

In accordance with the present invention and as is set forth below in greater detail, pipe marking apparatus 10 utilizes apparatus which applies a permanent encoded marking to shaft 21 of drill pipe 20 by creating localized variations or anomalies in the drill pipe. During this marking process, the pipe identification markings may be applied in an arrangement which encircles shaft 21, moves longitudinally along shaft 21, or moves diagonally along shaft 21. In the anticipated use of the present invention, relative movement between pipe marking apparatus 10 and drill pipe 20 in the direction indicated by arrows 11 facilitates an encircling code marking while relative movement between apparatus 10 and drill pipe 20 in the directions indicated by arrows 12 facilitates longitudinal pipe marking. Simultaneously relative movement in the directions shown by arrows 11 and 12 produces angled encoding. It will be apparent to those skilled in the art that the important aspect to be understood is the relative movement between pipe marking apparatus 10 and drill pipe 20. Thus, in a given pipe marking operation, it may be preferable to maintain pipe marking apparatus 10 in a fixed position while rotating drill pipe 20 in the directions indicated by arrows 11 and/or moving drill pipe 20 in the directions indicated by arrows 12. Alternatively, it may be preferable in a given operation to maintain drill pipe 20 in a fixed position while moving pipe marking apparatus 10 in the directions indicated by arrows 11 or 12 to achieve the coded marking. The choice of which method of obtaining relative movement for encoding is entirely subject to the needs of a particular operation and it will be understood that either or both fall within the spirit and scope of the present invention.

Figure 2:
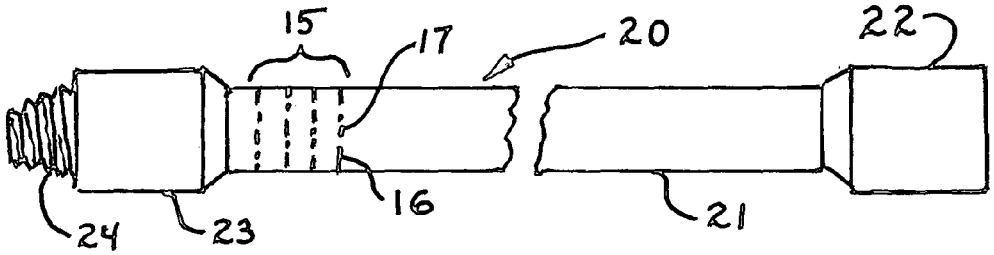
FIG. 2 sets forth a typical coded drill pipe having received the present invention identification encoded information.

FIG. 2 sets forth drill pipe 20 following the pipe marking process of the present invention. As described above, drill pipe 20 is entirely conventional in fabrication having an elongated cylindrical shaft 21, a box end 22 and a pin end 23. As is also mentioned above, pin end 23 supports a tapered thread 24 while box end 22 supports an internal thread (not shown) compatible with thread 24 to facilitate joining an adjacent drill pipe. Of importance to note in FIG. 2 is the presence of pipe identification markings 15 formed upon drill pipe shaft 21 in proximity to pin end 23. As described below, drill pipe identification markings 15 may be formed on drill pipe shaft 21 using any one of a variety of methods such as welding, burning or engraving. The essential features of any selected method is the creation of encoded localized variations or anomalies in the drill pipe which may later be sensed by an appropriate sensor responding to such localized variations or anomalies to recover the encoded data. While it is recognized that a virtually endless variety of encoding systems may be utilized in practicing the present invention pipe identification marking, for purposes of illustration FIG. 2 shows a pipe identification marking 15 which is oriented in an encircling array and comprises a plurality of identification data bands encircling shaft 21. By way of further illustration, and not limitation, FIG. 2 illustrates the use of a pipe identification encoding method which employs a plurality of short duration "dots" 17 together with longer duration "dashes" 16. In the preferred fabrication of the invention, it is believed advantageous to place pipe identification marking array 15 in close proximity to pin end 23 of drill pipe 20. This location is preferred inasmuch as the larger diameter of pin end 23 tends to shield identification array 15 from excessive wear during use. It will be apparent, however, that identification marking array 15 may be placed at alternative positions upon drill pipe 20 without departing from spirit and scope of the present invention.

Figure 3:
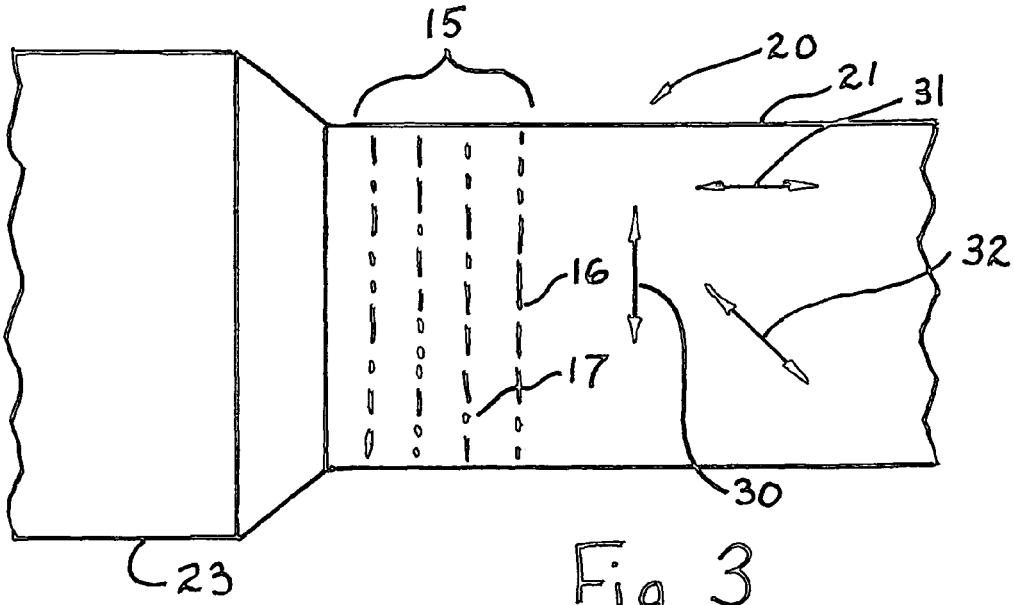
FIG. 3 sets forth an enlarged view of a portion of a drill pipe bearing a typical encoded identification marking.

FIG. 3 sets forth a partial enlarged view of pin end 23 of drill pipe 20 bearing marking array 15. Thus, as described above, drill pipe 20 includes an enlarged diameter pin end 23 supporting tapered threads 24. As is also described above, drill pipe 20 includes an elongated generally cylindrical shaft 21 upon which a pipe identification marking array 15 has been formed. As is better shown in FIG. 4, the preferred method for forming array 15 upon pipe shaft 21 utilizes a welding process. As is also mentioned above, marking array 15 may be formed upon shaft 21 utilizing an electric arc burning process or laser engraving. In any event, array 15 comprises a plurality of short duration dots 17 together with longer duration dashes 16. It is important to note that array 15 may be formed during the marking process in an encircling array by providing relative movement between drill pipe 20 and pipe marking apparatus 10 (seen in FIG. 1) in the direction indicated by arrows 30. Alternatively, relative movement between pipe marking apparatus 10 and drill pipe 20 in the longitudinal direction indicated by arrows 31 may also be employed. By further alternative, pipe identification marking array 15 may be formed by applying relative movement between pipe marking apparatus 10 and drill pipe 20 at an angle such as indicated by arrows 32.

Figure 4:
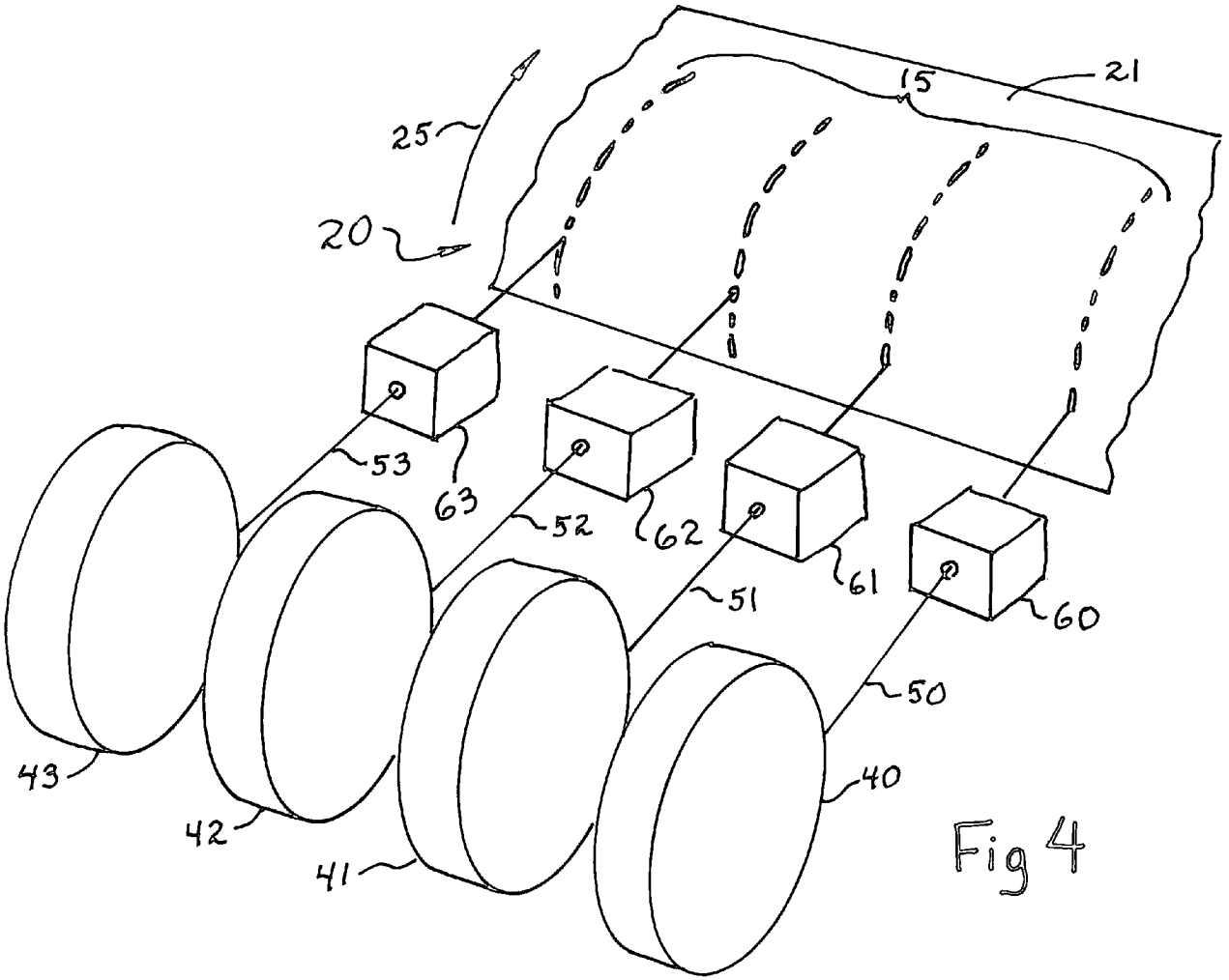
FIG. 4 sets forth a perspective diagram of a pipe marking device constructed in accordance with the present invention.

FIG. 4 sets forth a simplified perspective diagram illustrating the pipe marking apparatus of the present invention. It will be apparent to those skilled in the art that a variety of welding apparatus may be utilized without departing from the spirit and scope of the present invention. Accordingly, a plurality of electrode wire welding apparatus such as those illustrated in FIG. 4 may be utilized. However, it is recognized that conventional "stick" welding apparatus may be employed. It is also recognized that the pipe identification marking of the present invention system may employ an electric arc burning tool laser engraver to alter the surface of the drill pipe shaft and embed a detectable mark without departing from the spirit and scope of the present invention.

More specifically, FIG. 4 sets forth a plurality of conventional wire electrode welding devices 40, 41, 42 and 43 from which a corresponding plurality of wire electrodes 50, 51, 52 and 53 are drawn. In further accordance with conventional fabrication techniques, wire electrode welders 40, 41, 42 and 43 further include a plurality of wire pullers 60, 61, 62 and 63 respectively. As mentioned above, drill pipe shaft 21 is positioned in proximity to the drill pipe marking apparatus and is supported for rotation in the direction indicated by arrow 25. It will be apparent to those skilled in the art that wire electrode welders 40 through 43 together with pullers 60 through 63 are fabricated in accordance with conventional fabrication techniques. In the preferred fabrication of the present invention and as is set forth below in FIG. 5, welders 40 through 43 and pullers 60 through 63 are controlled by a computer processor to weld encoded markings upon the surface of drill pipe shaft 21. In the illustration shown in FIG. 4, an encircling orientation of pipe markings is being applied. Accordingly, it is anticipated in the illustration shown in FIG. 4 that relative movement between shaft 21 and the welding apparatus in the direction indicated by arrow 25 is provided. Once again it will be apparent that this relative motion may be provided by rotatably supporting drill pipe 20 or, alternatively, rotatably supporting the welding apparatus. In either event, a succession of drill pipe identification encoded data is welded upon shaft 21 to provide marking array 15. Thus, as shaft 21 rotates in the direction indicated by arrow 25, wire electrode welders 40 through 43 and pullers 60 through 63 operate to weld array 15 upon the surface of shaft 21.

Figure 5:
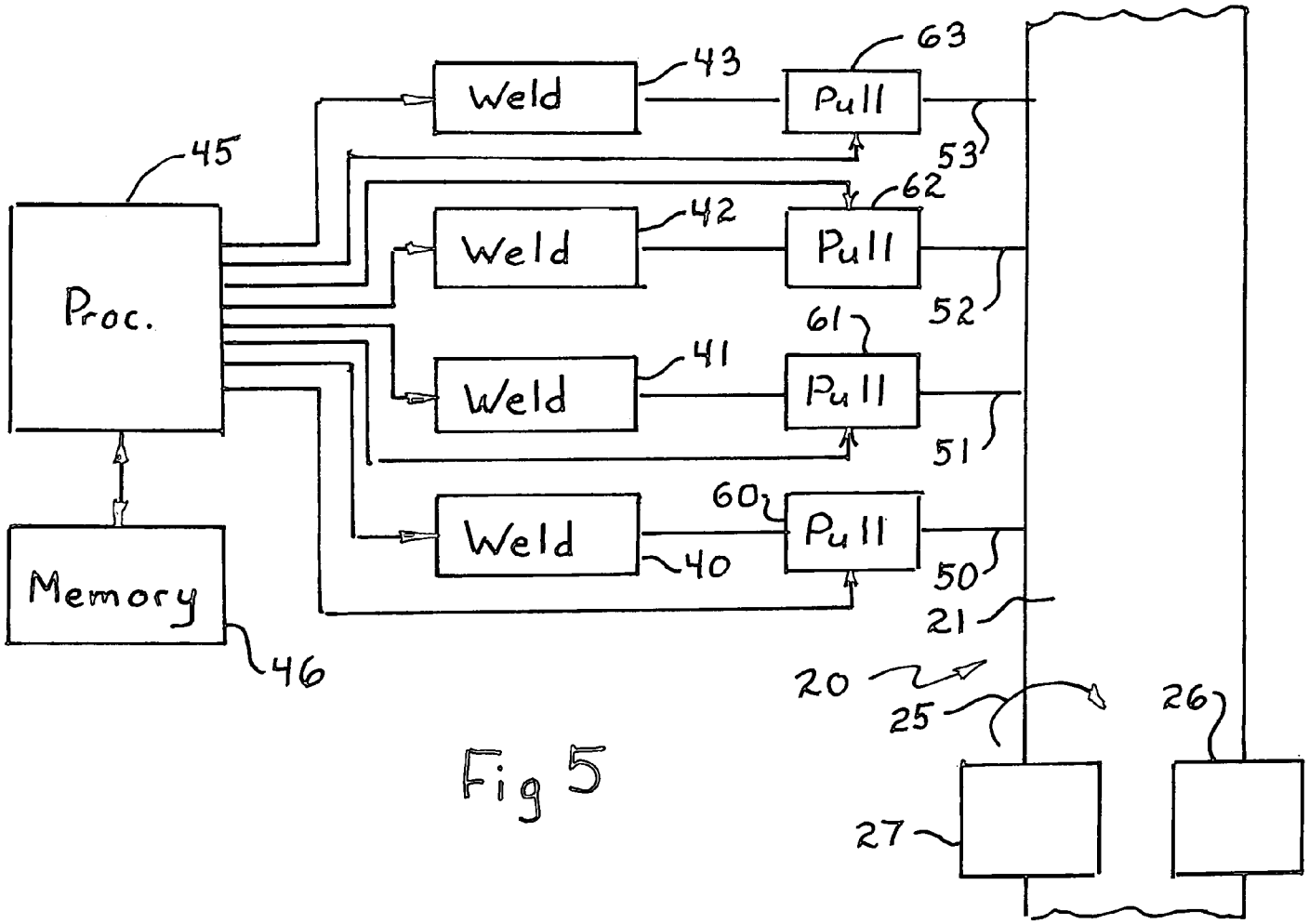
FIG. 5 sets forth a block diagram of the basic pipe marking apparatus of the present invention.

FIG. 5 sets forth a block diagram of a drill pipe identification method and apparatus constructed in accordance with the present invention. A drill pipe shaft 21 is rotatable supported by a conventional pipe support apparatus 26 and 27. Apparatus 26 and 27 support drill shaft 21 in a rotatable support which facilitates rotating shaft 21 in the direction indicated by arrow 25. Thus, shaft supports 26 and 27 may be entirely conventional in fabrication and may for example comprise the types of rotatable supports employed by practitioners to inspect or recondition drill pipe. The essential function of supports 26 and 27 is to provide controlled rotation of drill pipe shaft 21 in the direction indicated by arrow 25.

In accordance with the present invention, drill pipe marking apparatus 10 includes a plurality of conventional power-driven wire electrode welding devices 40, 41, 42 and 43. Welding devices 40 through 43 support respective wire electrodes 50, 51, 52 and 53 which are drawn from apparatus 40 through 43 by a plurality of controlled pullers 60 through 63 respectively. In accordance with conventional welding techniques, wire electrode welding apparatus 40 through 43 and pullers 60 through 63 cooperate to draw wire electrodes 50 through 53 from the supply supported within welders 40 through 43. In further accordance with conventional fabrication techniques, welders 40 through 43 each include apparatus (not shown) for applying electrical power to electrodes 50 through 53 which facilitates welding upon the surface of drill pipe shaft 21. In accordance with the present invention, a computer processor 45 having an associated memory 46 is operatively coupled to welders 40 through 43 and pullers 60 through 63 to advance electrodes 50 through 53 in accordance with the desired encoding process to weld the pluralities of dots and dashes upon shaft 21 which form the pipe identification marking. As processor 45 generates the pipe identification to be encoded upon shaft 21, the identification is stored within memory 46 for further use.

Figure 6:
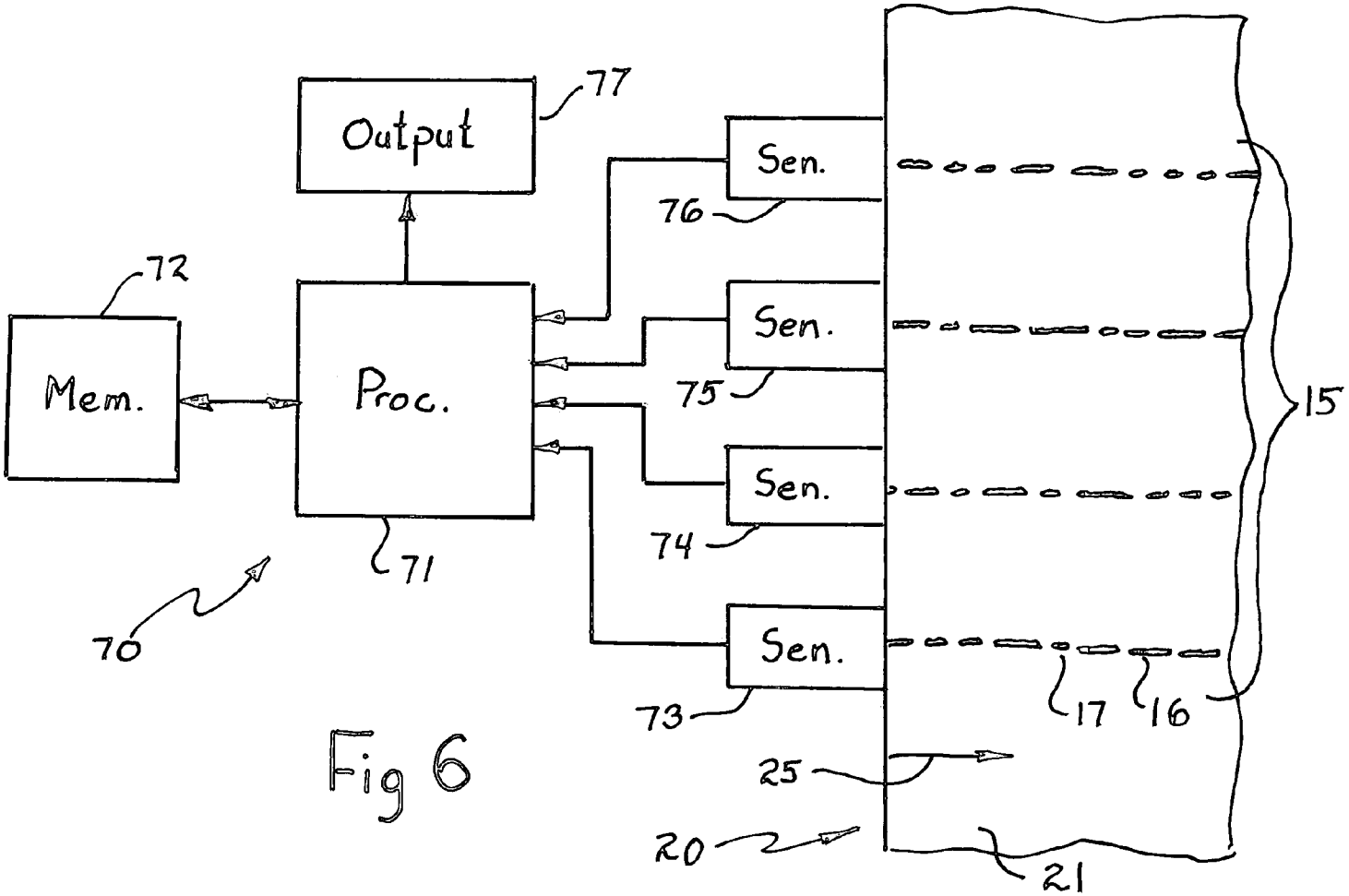
FIG. 6 sets forth a block diagram of a pipe identification code reader constructed in accordance with the present invention.

FIG. 6 sets forth a block diagram of a drill pipe identification reader constructed in accordance with the present invention. A drill pipe identification reader generally referenced by numeral 70 includes a processor 71 having an associated memory 72 coupled thereto. Identification reader 70 further includes a plurality of sensors 73, 74, 75 and 76. Sensors 73 through 76 are positioned in proximity to a drill pipe shaft 21. Means (not show) are provided for rotating shaft 21 in the direction indicated by arrow 25. In the circumstances illustrated in FIG. 6, shaft 21 has been previously marked utilizing the above-described welding, engraving or burning processes to support a pipe identification marking array 15. As mentioned above, identification array 15 may utilize virtually any combination of marking symbols or encoding organizations without departing from the spirit and scope of the present invention. In the illustration shown in FIGS. 5 and 6, a plurality of short durations dots 17 and longer duration dashes 16 are utilized in encoding the information within pipe identification marking array 15. Sensors 73 through 76 may comprise virtually any sensor which is capable of sensing and distinguishing dots 17 from dashes 16 as pipe shaft 21 is rotated in the direction indicated by arrow 25. Thus, sensors 73 through 76 may comprise mechanical sensors able to respond to the physical contours of dots 17 and dashes 16 to detect the coded array. Alternatively, sensors 73 through 76 may comprise optical detectors capable of sensing the presence of dots 17 and dashes 16 utilizing the reflective or optical characteristics of the welded or burned encoded information. Preferably, however, sensors 73 through 76 comprise magnetic anomaly detectors of the type utilized in magnetic inspection processing for defects and such which are currently available and widely utilized in the industry. Thus, utilizing magnetic anomaly detectors for sensors 73, 74, 75 and 76 facilitates the sensing and "decoding" of the coded combinations of dots 17 and dashes 16 within coded array 15. The sensed dot and dash data is coupled to processor 17 which organizes the encoded information and deciphers it in accordance with the stored instruction set within memory 72. Once the identification data has been detected by sensors 73 through 76 and decoded by processor 71 and memory 72, the identification data may be stored within memory 72 for further use. Additionally, an output device 77 such as a numeric or alphanumeric reader 77 is configured by processor 71 to provide the identification of the pipe being examined. In the preferred fabrication of the invention, this identification information may be utilized to access the history and other relevant data of the drill pipe being examined which is centrally stored in a data base.

The present invention concept provides for the marking of oil field drill pipe with a bar code type system that provides long-life during the drill pipes use. The present invention system can also be employed on other down-hole equipment. The preferred application of the encoded identification and information data utilized in the present invention is selected to place the data "in the shadow" of the larger diameter portions of the drill pipe to protect the encoded data from direct abrasion during the drilling process. Typically, the area selected for encoded information is just above the pin end taper. The encoded identification data is preferably applied by a direct weld process in the form of circumferential or axial stripes, dashes, long and short. The encoded data may be read either circumferentially or longitudinally.

In prior attempts to provided encoded identification data upon drill pipe, the encoded information did not reliably survive the abrasion and corrosion inherent in the down hole service environment. Unfortunately, unbranded or non-indicator bearing pipe proves very difficult to track and maintain identification thereof in the oil field use. Preferably, the encoded weld process deposits a corrosion resistant non-magnetic material to facilitate the detection thereof by the reading apparatus due to its distinct characteristic difference from the magnetic base drill pipe metal. The encoded data is preferably applied in a low stress area of the drill pipe with a preheat processing step in order to minimize the metallurgical impact upon the material of the drill pipe and thereby avoid any potential induced failure.

The identification code reading instrument may utilize a system which responds to the magnetic variations created by the welded identification code due to its distinction from the non-magnetic drill pipe material. Preferably the reader senses the encoded data by detecting the difference in the magnetic characteristics of the encoding material and the base metal.

As an alternative to the magnetic welding material process, the encoding may be carried forward by "burning in" the encoded data which causes a weld penetration below the surface of the drill pipe. This burned in data encoding allows the wear of the drill pipe without damaging the encoded material. During extended service, the drill pipe may be encoded a second time following the shadow of the remaining encoded material.

The weld formation of encoded data may be applied manually using a single wire or electrode or may be applied utilizing the above-described multiple wire welding heads. The encoding may be carried forward by the manufacture as part of the original equipment process or may be accomplished readily in the field. In accordance with any additional advantage of the present invention system, the encoding may be performed in a manner and using materials which discourage or frustrate alteration of the identification data. This will prove especially effective in frustrating the attempts of so-called "pipe rustlers" who practice the unauthorized transport and sale of drill pipes within the industry.

The identification data typically may include an independent serial number uniquely identifying each drill pipe or piece of tool equipment. The identity may indicate the actual time and date of manufacture as well as successive uses as the pipe performs throughout the industry. The encoded data may correspondingly be read and tracked allowing the user to obtain a complied history within a central storage. The system may, for example, provide that each person utilizing the pipe provides information documenting and defining such use to the central storage system all of which is coordinated by the unique identifying number. This in turn facilitates the tracking of the pipe by the manufacturer and users throughout the system. It also facilitates the operations of pipe inspectors since location, transportation and storage may be supported within the central data base. Ideally, each person utilizing the pipe will be required to scan and input the pipe data to compile the pipe history.

What has been shown is a drill pipe identification method and apparatus which facilitates the unique identification encoding of markings upon each drill pipe. The unique drill pipe identification markings are preferably applied using a computer controlled welding process and provide wear-resistant coded information which may be read by a magnetic anomaly reader in the field and utilized by well operators to access the history and relevant information stored within the system.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A method of imparting a drill pipe identification to a drill pipe comprising the steps of:

providing a drill pipe encoder having welding means for imparting localized welded anomalies directly upon a drill pipe;

creating localized welded anomalies upon a selected area of drill pipe by positioning said drill pipe encoder in proximity to a drill pipe and imparting relative movement between said drill pipe encoder and a drill pipe during said step of creating localized anomalies, said anomalies including raised deposits of weld material and magnetically detectable areas within the drill pipe; and controlling the locations of said welded anomalies upon the drill pipe in accordance with encoded drill pipe identification data that includes providing a unique drill pipe identification code to said identification data which uniquely distinguishes the encoded drill pipe from all other drill pipes.

2. The method set forth in claim 1 further including the steps of:

providing a reader having means for sensing and responding to said localized welded anomalies; and reading said encoded drill pipe identification data by sensing said localized welded anomalies.

3. The method set forth in claim 2 wherein said step of reading said encoded drill pipe identification data includes the steps of:

positioning said reader in proximity to a drill pipe near said localized welded anomalies on a drill pipe; and imparting relative movement between said reader and a drill pipe during said step of reading said encoded drill pipe identification data and sensing said raised deposits of weld material.

4. The method set forth in claim 2 wherein said step of reading said encoded drill pipe identification data includes the steps of:

positioning said reader in proximity to a drill pipe near said localized welded anomalies on a drill pipe; and imparting relative movement between said reader and a drill pipe during said step of reading said encoded drill pipe identification data and sensing magnetic variations of said weld material.

5. The method set forth in claim 4 wherein said reader includes a magnetic anomaly sensor and wherein said step of reading said encoded drill pipe identification data includes sensing magnetic anomalies in said drill pipe.

6. A method of imparting a drill pipe identification to a drill pipe comprising the steps of:

providing a drill pipe encoder having welding means for imparting localized weld bead areas directly upon the surface of a drill pipe;

positioning said drill pipe encoder in proximity to a drill pipe;

imparting relative movement between said drill pipe encoder and a drill pipe;

creating localized anomalies directly upon a selected area of a drill pipe during said relative movement by forming localized surface anomalies and magnetic anomalies; and controlling said anomalies in accordance with encoded drill pipe identification data which uniquely identifies the encoded drill pipe including a unique drill pipe identification code to said identification data which uniquely distinguishes the encoded drill pipe from all other drill pipes.

7. The method set forth in claim 6 further including the steps of:

providing a reader having means for sensing and responding to said localized welded anomalies; and reading said encoded drill pipe identification data by sensing said localized welded anomalies.

8. The method set forth in claim 7 wherein said welding means for imparting localized anomalies to a drill pipe includes a welder and wherein said step of creating localized anomalies upon a selected area of a drill pipe includes the step of welding upon a drill pipe.

9. The method set forth in claim 8 wherein said reader includes a magnetic anomaly sensor and wherein said step of reading said encoded drill pipe identification data includes sensing magnetic anomalies in said drill pipe.

10. The method set forth in claim 8 wherein said reader includes a surface variation sensor and wherein said step of reading said encoded drill pipe identification data includes sensing raised weld beads in said drill pipe.

* * * * *